United States Patent [19]

Shimizu

[11] Patent Number: 5,029,544

[45] Date of Patent: Jul. 9, 1991

[54] OSCILLATING LOOP TAKER FOR A SEWING MACHINE

[75] Inventor: Hiromitsu Shimizu, Osaka, Japan

[73] Assignees: Hirose Manufacturing Co., Ltd., Osaka; Brother Kogyo Kabushiki Kaisha, Aichi, both of Japan

[21] Appl. No.: 484,859

[22] Filed: Feb. 27, 1990

[30] Foreign Application Priority Data

Feb. 27, 1989 [JP] Japan ..... 1-47426

[51] Int. Cl.[5] ..... D05B 57/10

[52] U.S. Cl. ..... 112/192; 112/196; 112/181; 112/252

[58] Field of Search ..... 112/25, 38, 55, 95, 112/159, 164, 165, 181, 183, 185, 189, 192, 196, 199, 201, 228, 230, 231, 232

[56] References Cited

U.S. PATENT DOCUMENTS

| | | | |
|---|---|---|---|
| 580,356 | 4/1897 | Allen | 112/232 |
| 1,398,872 | 11/1921 | McCollum | 112/196 |
| 1,570,075 | 1/1926 | Paine | 112/196 |
| 2,741,199 | 4/1956 | Siebrasse | 112/192 X |
| 2,851,977 | 9/1958 | Spaine | 112/181 X |
| 3,705,562 | 12/1972 | Hanyu | 112/232 |

FOREIGN PATENT DOCUMENTS

| | | | |
|---|---|---|---|
| 1190776 | 4/1965 | Fed. Rep. of Germany | 112/192 |
| 0539174 | 3/1922 | France | 112/181 |
| 0261490 | 12/1985 | Japan | 112/228 |

*Primary Examiner*—Werner H. Schroeder
*Assistant Examiner*—Ismael Izaguirre
*Attorney, Agent, or Firm*—Wenderoth, Lind & Ponack

[57] ABSTRACT

An oscillating loop taker includes a bobbin case holder having a needle thread guiding projection which with a wedge forms a recess in which fits a driver member. A radial dimension from an axis of rotation of the holder to an inner leading edge portion of the projection is less than a radial dimension from such axis to an inner surface of the holder defining a space within which is housed a projection. The inclination of a needle thread guide face at the recess side of the projection is set to a desired comparatively large value. The circumferential length of the needle thread guide face is made comparatively long to enable a needle thread to be easily transferred onto the outer circumferential face of the bobbin case. Thereby, the bobbin thread is permitted to pass between the inner peripheral face in the vicinity of the base end portion of the projection and the outer peripheral end portion of the bobbin case. This enables the bobbin case in the bobbin case holder to be enlarged, enabling the diameter of a bobbin accommodated in the bobbin case holder also, to be enlarged, and enabling the winding capacity of the bobbin thread wound on the bobbin to be increased.

4 Claims, 8 Drawing Sheets

OSCILLATING LOOP TAKER FOR A SEWING MACHINE

BACKGROUND OF THE INVENTION

1. Field of the Invention

This invention relates to an oscillating loop taker which preferably employed in a sewing machine for household and industrial uses.

2. Description of the Prior Art

FIG. 1 is a front elevational view showing a conventional oscillating loop taker 1, FIG. 2 is a perspective disassembled view of the oscillating loop taker 1 shown in FIG. 1, and FIG. 3 is a sectional view of the oscillating loop taker. The oscillating loop taker 1 to be employed in a sewing machine for household and industrial uses includes a bobbin case holder 3 supported by a bobbin case holder rib 2 being inserted in a hook groove formed on an inner peripheral surface of a cup-shaped hook body, not illustrated herein, a driver member 4 by which the bobbin case holder 3 is driven by half revolutions in the directions of arrows A1 and A2, and a bobbin case 7 in which a bobbin 6 in which a bobbin thread 5 is wound is accommodated. A rotation restraining member 7*a* is integrally formed with the bobbin case 7 and fits in a fitting recess of a bobbin case holder clamper, not illustrated herein, thereby preventing rotation of the bobbin case 7 upon rotation of the bobbin case holder. A lower spindle of a sewing machine is coaxially fixed at a mounting portion 8 of the driver member 4 and is driven by half revolutions rotary axis line l. When the driver member 4 rotates in the direction of an arrow A1, one end portion 9 in the peripheral direction thereof is brought into contact with a respective contacting portion of the bobbin case holder 3, thereby causing the bobbin case holder 3 to rotate in the direction of arrow A1, with the bobbin case 7 however being prevented from rotating. As end portion 9 of a driver member 4 reaches an upper dead point, the direction of rotation thereof is reversed to cause the driver member 4 to be driver for rotation from the direction of arrow Al to the direction of arrow A2. At this time, an opposite end portion 11 in the peripheral direction of the driver member 4 is brought into contact with an inner surface of a recess formed in the vicinity of a wedge 12 of the bobbin case holder 3, thereby causing the bobbin case holder 3 to rotate in the direction of arrow A2, with the bobbin case 7 however being prevented from rotating.

In the oscillating loop taker 1 which can be driver for half turns or half revolutions as described above, a needle thread carried by a needle 14 which can vertically reciprocate is caught by the wedge 12 and the bobbin case holder 3 is rotated by a half turn in the direction of arrow A1 by the driver member 4, thereby causing a needle thread loop to be formed. At this time, the needle thread is arranged at a lower portion of the loop taker as shown by the dashed line 15 and moves in the direction of an arrow 18, sliding along with a guiding face 17 of a thread guiding projection 16 which forms the recess 13 together with the wedge 12. Then the needle thread 15 transfers to the outer peripheral surface of the bobbin case 7 by vertical movements of a balance (not illustrated) of the sewing machine body. Thus, as the balance is elevated, the needle thread 15 shifts over, sliding on the outer peripheral surface of the bobbin case 7. The needle thread 15 which is thus pulled upwards by the balance is engaged with the bobbin thread which is drawn out from the bobbin 6 in the bobbin case 7, thereby causing a swing joint to be formed.

When the needle thread 15 transfers to the outer peripheral surface of the bobbin case 7 from the wedge 12, the bobbin case holder 3 reversely turns in the direction of arrow A2 and returns to the initial position (the solid line position shown in FIG. 1). And the bobbin case holder 3 is again driven in the direction of arrow Al and catches the needle thread carried to the vicinity of the wedge 12 by a downstroke movement of the needle 14, thereby causing a need thread loop to be formed. A series of movements as mentioned above is repeated, thereby causing consecutive sewing joints to be formed.

When the oscillating loop taker 1 is utilized in a sewing machine for household or industrial use, then when the bobbin thread 5 of the bobbin case 6 is consumed, the bobbin 6 from which the bobbin thread 5 has been consumed must be replaced with a bobbin in which new bobbin thread has been wound. Especially, in a sewing machine for industrial use, the sewing speed of which is fast and the dewing volume of which is large, the bobbin 6 must be replaced frequently, and the sewing efficiency thus will be reduced.

The winding capacity of the bobbin thread 5 can be increased by enlarging the diameter D of the bobbin 6 and the width B in the axial direction of the bobbin 6. However, if the diameter D of the bobbin 6 is enlarged, the bobbin case holder 3 must be accordingly enlarged. If the bobbin case holder 3 is enlarged, the needle thread loop is also enlarged, thereby causing not only thread tightness to be worsened and the likely production of balls of thread, but also vibrations accompanying the half turn movements of the bobbin case holder will be increased and noise accordingly will be increased. Also, if the width B of the bobbin 6 is enlarged, it will become difficult for the needle thread loop to transfer onto the bobbin case 7. As a result, undesirable tension operates on the needle thread to cause the thread tightness to be worsened, and balls of thread may be produced with a reduction in sewing quality.

SUMMARY OF THE INVENTION

It is therefore an object of the invention to provide an oscillating loop taker of simple construction, which can solve the above problems and by which the winding capacity of bobbin thread to be wound in the bobbin can be increased by enlarging the bobbin without enlarging the bobbin case holder.

In order to accomplish the object, the invention provides an oscillating loop taker including a bobbin case holder having a needle thread guiding projection forming a recess with which a driver member is engaged, wherein an inner radial dimension from the axis of rotation of the bobbin case holder to an inner leading edge portion of the projection is less than an inner radial dimension from such axis to an inner holder surface defining a space in which a bobbin case is accommodated, at a base end portion of the projection. The inclination of a needle thread guide surface at the recess side of the projection can be made as large as desired, and the circumferential or peripheral length of the needle thread guide surface can be made comparatively large, thereby enabling the needle thread to be easily transferred onto the outer peripheral surface of the bobbin case.

In a preferred embodiment, a stepped surface portion having a reduced diameter is formed on the outer peripheral surface of the bobbin case to extend in the peripheral direction in order to avoid interference with the needle thread guiding projection.

In another preferred embodiment, the outer end surface of the bobbin case is spaced an additional distance of about 3 mm in the axial direction from the open end of the bobbin case holder.

In a still another preferred embodiment, the bobbin case is formed to be curved, so that as a corner portion at which the needle thread transfers from the outer peripheral surface of the bobbin case to the outer end surface thereof is moved upstream relative to the direction of passage of the needle thread, the axial length of the bobbin case can be decreased.

According to the invention, as the needle thread is easily transferred to the outer peripheral surface of the bobbin case by setting the inclination of the needle thread guide surface at the recess side of the needle thread guiding projection to a desired value and by increasing peripheral length thereof, the needle thread caught by the wedge of the bobbin case holder is guided along the needle thread guide surface of the recess as the bobbin case holder rotates, thereby enabling the needle thread to be transferred easily from the needle thread guide surface onto the outer peripheral surface of the bobbin case and ensuring smooth thread transfer. Therefore, it is possible to form good sewing joints without unnecessary high tension operating on the needle thread and without producing thread balls.

As the base end portion of the projection is formed such that the inner leading edge portion of the projection is radially inward of the inner surface defining the bobbin case accommodating space, the bobbin thread is permitted to pass between the inner peripheral face in the vicinity of the base end portion and the outer peripheral end portion of the bobbin case, and it is possible to enlarge the bobbin case inn the bobbin case holder. Thereby, the diameter of the bobbin accommodated in the bobbin case holder may be enlarged, and accordingly the winding capacity of the bobbin thread wound in the bobbin can be increased. Therefore, it is possible to reduce the frequency of replacement of bobbins and to greatly increase sewing efficiency.

Also according to the invention, even though the outer diameter of the bobbin case accommodated in the bobbin case holder is made larger, since a portion of the outer diameter of the bobbin case is reduced to prevent the interference with the needle thread guiding projection, there is no possibility that the leading edge portion of the needle thread guiding projection will be brought into contact with the outer peripheral surface of the bobbin case. Thereby, the bobbin case holder will not interfere with the bobbin case, and the bobbin case holder will be oscillated smoothly.

BRIEF DESCRIPTION OF THE DRAWINGS

These and other objects of the invention and advantages and features thereof will be made more apparent in the ensuing detailed description with reference to the accompanying drawings, wherein.

DETAILED DESCRIPTION OF THE PREFERRED EMBODIMENTS

Figure 4:
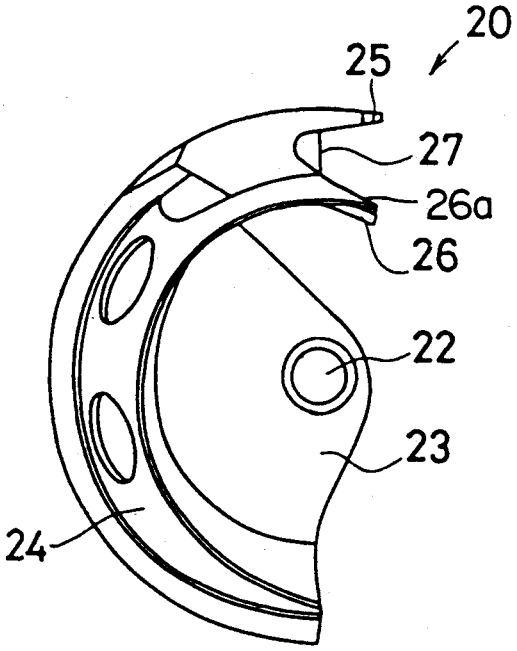
FIG. 4 is a front elevation view of one preferred embodiment of the invention.
Figure 5:
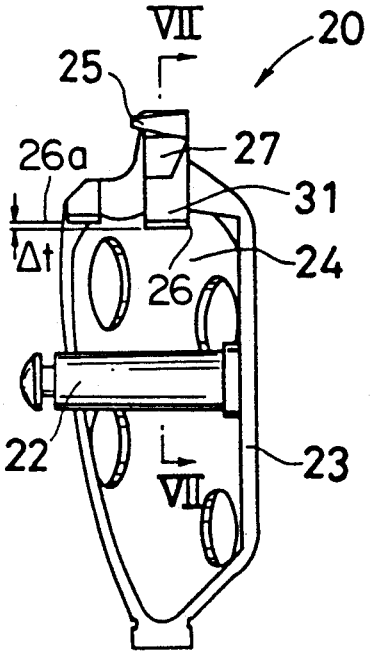
FIG. 5 is a side view from the right side of FIG. 4.
Figure 6:
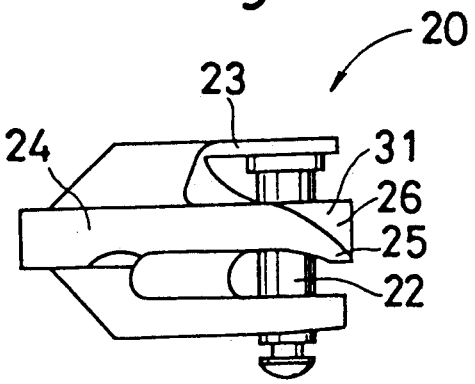
FIG. 6 is a plan view of the structure shown in FIG. 4.

As shown in FIGS. 4–6, a bobbin case holder 20 provided in an oscillating loop taker according to the invention has a bottom portion 23 from which projects a stud 22 and a peripheral edge portion 24. A wedge 25 is formed at the peripheral edge portion 24, and a needle thread guiding projection 26 is also formed radially inwardly of wedge 25. A recess 27, into which a driver member 40 described hereinafter is engaged, is formed between the wedge 25 and the needle thread guiding projection 26. Also, a projection 26*a* is spaced axially of projection 26. Projection 26*a* is located radially outwardly of projection 26 by a distance $\Delta t$.

Figure 7:
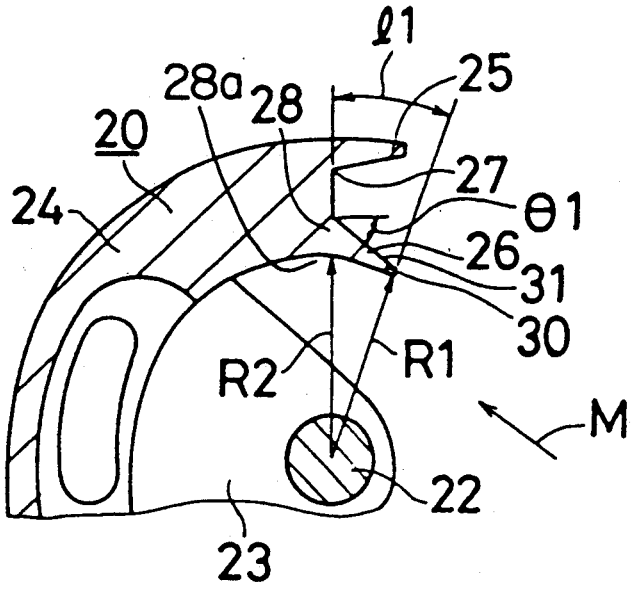
FIG. 7 is an enlarged sectional view taken along lines VII—VII of FIG. 5.
Figure 8:
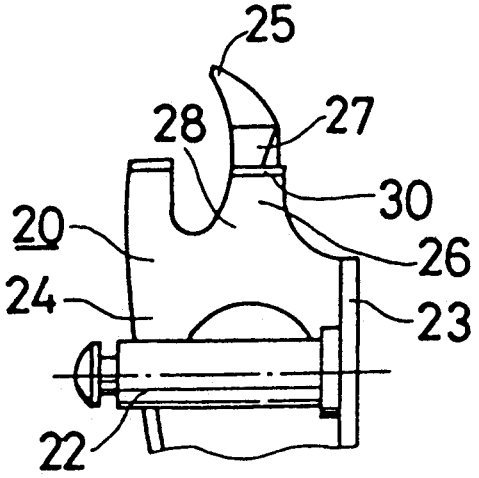
FIG. 8 is a partially enlarged bottom plane view in the vicinity of a needle thread guiding projection as viewed in the direction of arrow M in FIG. 7.

As shown in FIGS. 7 and 8, a radial dimension R1 between the rotational center of stud 22 and a leading edge portion 30 of the needle thread guiding projection 26 is formed to be less than a radial dimension between such center of stud 22 and a surface 28*a* of a base end portion 28 of the projection 26 ($R1 < R2$). Thereby, even though a circumferential or peripheral length $\Delta 1$ of the needle thread guiding projection 26 is lengthened, the strength of projection 26 can be prevented from being lowered by maintaining a sufficient thickness thereof. Also, an angle $\Theta 1$ formed between a needle thread guide surface 31 of the projection 26 adjacent recess 27 and a line or direction tangential to the base end of projection portion 28 can be made larger than would be possible if dimensions R1 and R2 were equal ($R1 = R2$). Moreover, by increasing the length l 1 in the peripheral direction of the needle thread guide face 31, it is possible for a needle thread caught by the wedge 25 easily to be transferred onto an outer peripheral surface 47 of a bobbin case 37, as mentioned hereinafter. In view of the above structure, it is possible to make a smooth and reliable transfer of a needle thread caught by the wedge 25.

Figure 1:
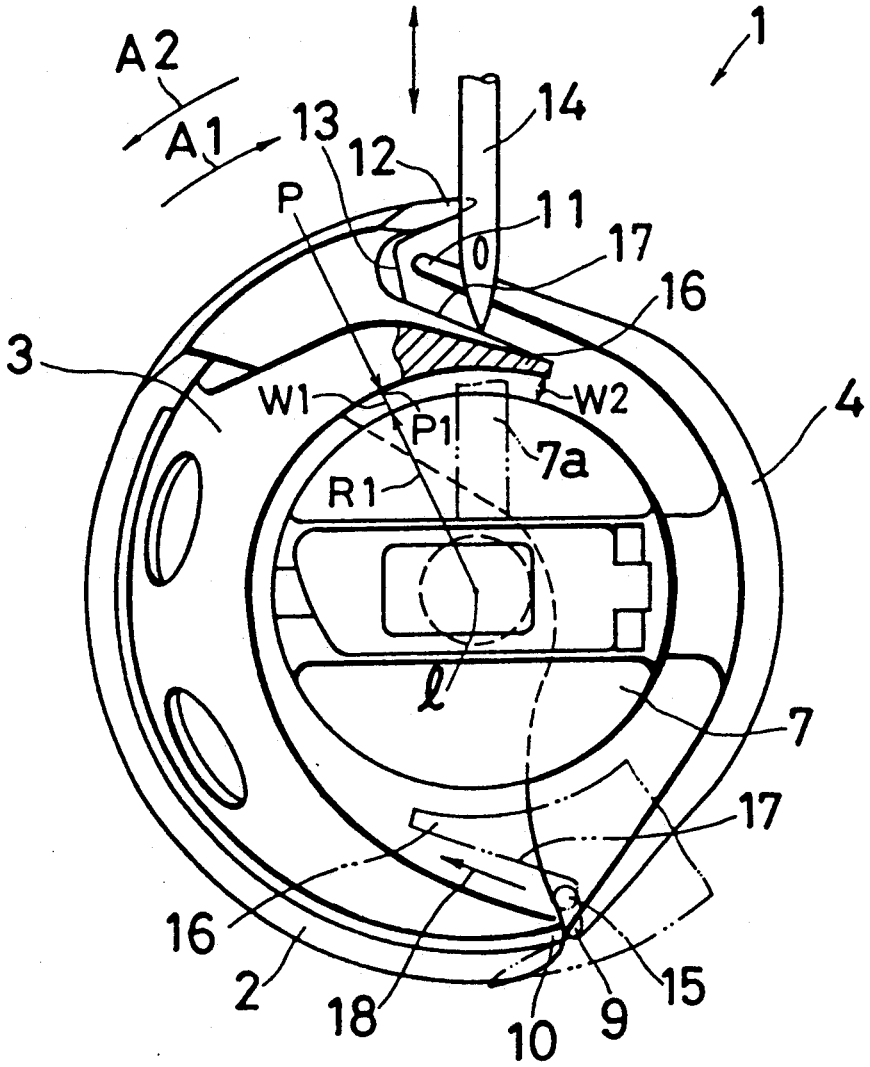
Fig. 1 PRIOR ART
FIG. 1 is a front elevational view of conventional oscillating loop taker.
Figure 2:
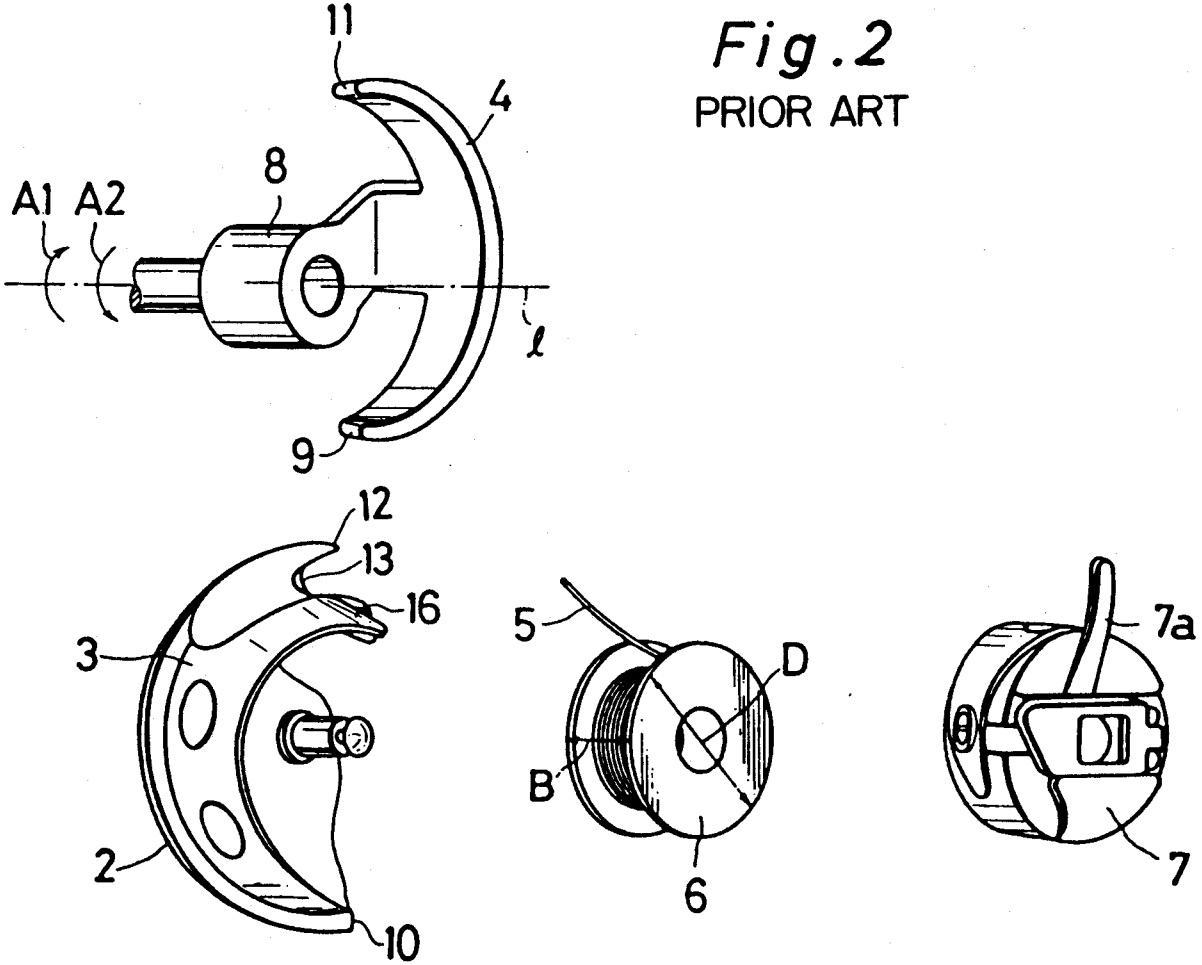
Fig. 2 PRIOR ART
FIG. 2 is perspective disassembled view of the oscillating loop taker of FIG. 1.

Again with reference to FIG. 1, on a line (l −P) of a radius connecting the rotary axial line l of the bobbin case holder 3 to a base end portion of the needle thread guiding projection 16, it is necessary that an interval W1 usually be approximately 1 mm become this position defines a channel from which the bobbin thread is drawn out of the bobbin case 7 and is introduced to a needle hole by a control spring. As the bobbin case 7 is placed at a fixed position and the bobbin case holder 3 is driven by half turns, this interval must always meet a requirement that $W1 \geqq 1$ mm at the downstream side in the direction of arrow A2 from the position of P1 on the line l – P shown in FIG. 1. However, an interval W2 is never subjected to the above restriction at the downstream side (in the direction of the leading edge of the projection 16) in the direction of arrow A1. Therefore, the dimension R1 may be drawn near the outer periphery of the bobbin case. To the contrary, if only the enlarged R2 is enlarged with the dimension R1 remaining unchanged, the radius of the bobbin case can be enlarged to a value which is near to the dimension Rl, and furthermore, the angle Θ1 (FIG. 7) of the projection can be retained at a desired value which is not different from the conventional value, thereby causing bobbin case 37 accommodated in the bobbin case holder 20 to be enlarged. Therefore, a bobbin 39 which will be accommodated in the bobbin case 37 can be enlarged, thereby increasing the winding capacity of the bobbin thread.

Figure 9:
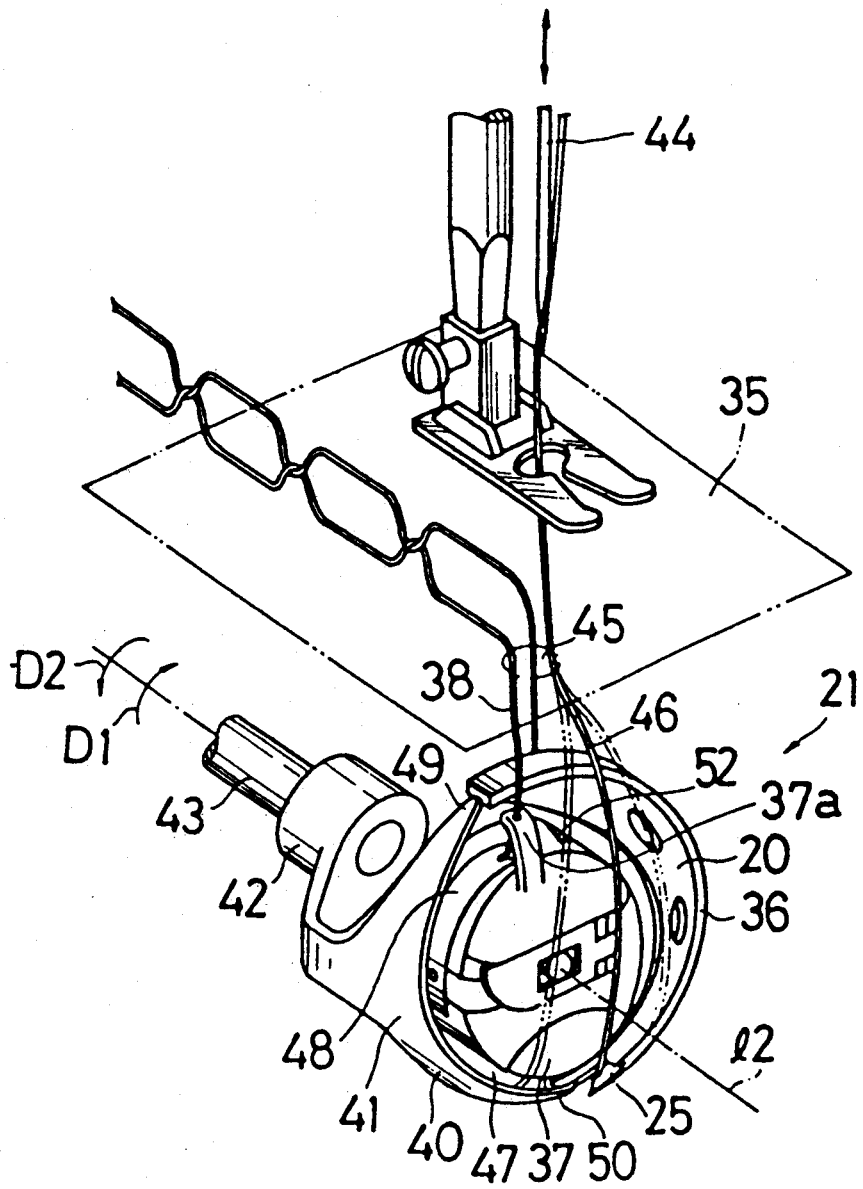
FIG. 9 is a perspective view of an oscillating loop taker furnished with the bobbin case holder shown in FIGS. 4 through 8.

FIG. 9 illustrates an oscillating loop taker 21 furnished with the bobbin case holder 20 shown in FIGS. 4 through 8. Oscillating loop taker 21 furnished with the bobbin case holder 20 is arranged beneath a needle plate 35 on a sewing machine bed. Bobbin case holder 20 is supported in oscillating loop taker 21 with a bobbin case holder rib 36 inserted in a hook groove formed on an inner peripheral surface of a cup-shaped hook body, not illustrated herein, and the bobbin case 37 is attached to stud 22 which extends from the bottom portion 23 of bobbin case holder 20. Bobbin 39 in which is wound bobbin thread 38 is housed in bobbin case 37.

Driver member 40 is arranged on the opposite side of a rotary axis l2 relative to bobbin case holder 20. The driver member 40 has a rotary axis coincident with rotary axis l2 of the bobbin case holder 20, and a lower spindle 43 of the sewing machine is fixed to a mounting portion 42 integral with body 41 of the driver member 40. The rotary axis of the lower spindle 43 is coincident with the rotary axes of the bobbin case holder 20 and the driver member 40.

As a sewing operation is started, the lower spindle 43 is driven and reciprocated by half turns or revolutions in the directions of arrows Dl and D2 around the rotary axis thereof. At the same time, a needle 44 is vertically reciprocated in associations with the lower spindle 43, thereby causing a needle thread 46 to be brought to the vicinity of the wedge 25 of the bobbin case holder 20 through a needle hole 45 formed in the needle plate 35. The bobbin thread wound in the bobbin 39 housed in the bobbin case 37 is elastically pushed to the outer circumferential surface 47 of the bobbin case 37 through a bobbin thread inserting hole by means of a bobbin thread regulating spring 48 and is led upwardly through the needle hole 45 in needle plate 35. A rotation restraining member 37*a* is formed integrally with the bobbin case 37 and fits in a recess of a bobbin case holder clamper (not illustrated herein), thereby preventing rotation of the bobbin case 37 upon oscillation of the bobbin case holder 20.

The driver member 40 is driven and reciprocated by half turns or revolutions in the directions of arrows D12 and D2 by the lower spindle 43. When the driver member 40 is rotated in the direction of arrow Dl, an end portion 49 of member 40 is brought into contact with the bobbin case holder 20, thereby causing the bobbin case holder 20 to be driven and turned by a half revolution in the direction of arrow D1, with however rotation of the bobbin case 37 being prevented. Also, when the driver member 40 is rotated in the direction of arrow D2, an opposite end portion of the driver member 40 is brought into contact with the inner surface of the recess 27, thereby causing the bobbin case holder 20 to be driven and rotated by a half revolution in the direction of arrow D2, reverse to the direction D1, with rotation of the bobbin case being prevented.

Figure 10:
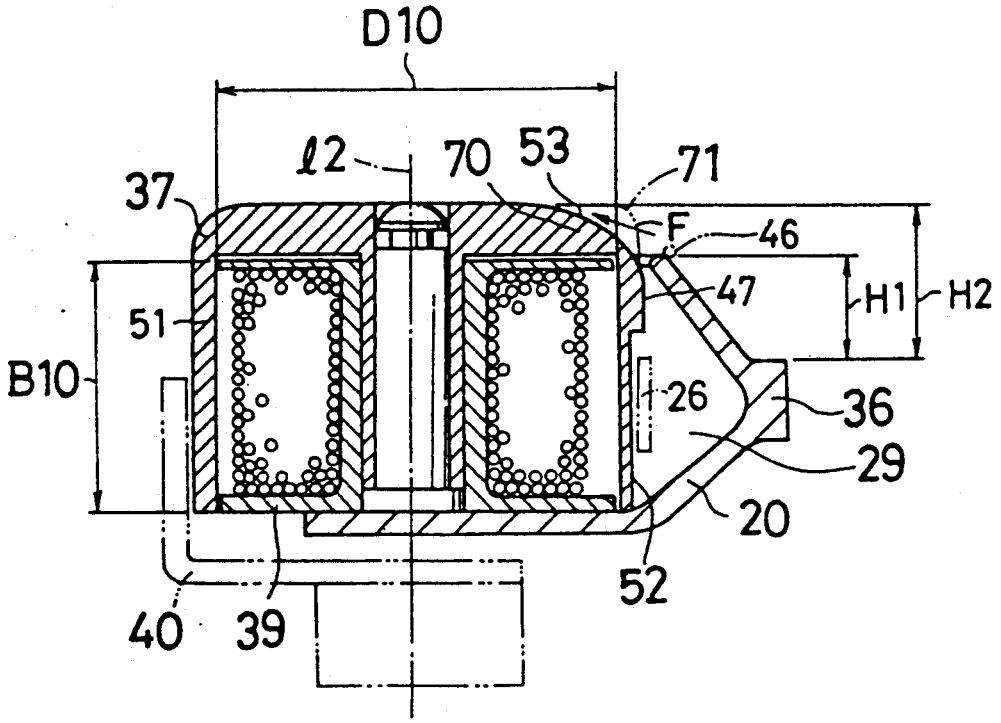
FIG. 10 is a partially enlarged sectional view of such oscillating loop taker.

Thus, as the bobbin case holder 20 is driven and reciprocated in the directions of arrows D1 and D2, there is a possibility for the needle thread guiding projection 26 of the bobbin case holder 20 to be brought into contact with the outer circumferential face 47 of the bobbin case 37 since the needle thread guiding projection 26 is inclined inwardly of the radial direction, as shown in FIGS. 7 and 8. For this reason, as shown in FIG. 10, on a roughly straight cylindrical body 51 of the bobbin case 37, a recessed face 52 having an outer diameter less than the outer diameter of the cylindrical body 51 is formed circumferentially, at least in the area in which the projection 26 moves. The reason why the bobbin thread regulating spring 48 does not interfere with the inner circumferential face of the bobbin case holder 20 is that the dimension Rl of the leading edge portion 30 of the projection 26 and the dimension R2 of the base end portion 28 thereof are such that R2 >R1 and R2 is a value such that the inner circumferential face of the base end portion 28 will not interfere with the bobbin thread pushed by the bobbin thread regulating spring 48. Thereby, even though the bobbin case holder 20 is reciprocated in the directions of arrows Dl and D2, the vicinity of the leading edge portion 30 of the projection 26 is not brought into contact with the outer circumferential face 47 of the bobbin case 37 and the bobbin thread regulating spring 48 attached to the outer circumferential face 47 and does not disturb the reciprocation of the bobbin case holder 20.

Figure 11:
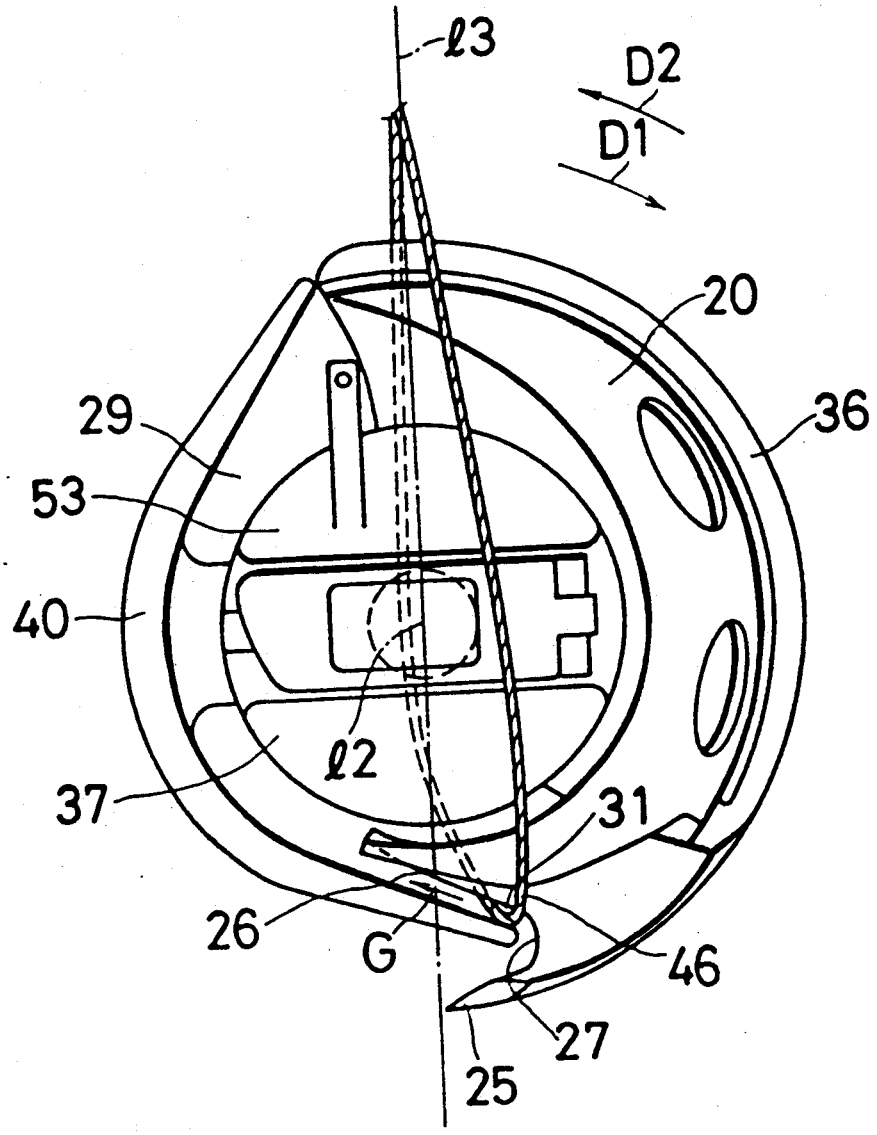
FIG. 11 is a front elevational view of a bobbin case holder illustrating transfer movements of a needle thread onto a bobbin case.

As the bobbin case holder 20 is driven in the direction of an arrow D1 by the driver member 40 by the structure discussed above, the needle thread 46 caught by the wedge 25 forms a loop as shown in FIG. 11, and the needle thread is guided in direction of an arrow F (FIG. 10) which is a passing-through direction of the needle thread. Then, at a position such that the leading edge of the wedge 25 intersects a vertical axis l3 parallel to the direction of movement of the needle 44, the needle thread 46 in the recess 27 is guided in the direction of an arrow G in FIG. 11 along with the needle thread guide face 31 and is transferred to the outer circumferential face 47 of the bobbin case 37. At this time, as the needle thread guide face 31 extends for the length l1 as described with reference to FIG. 7, the needle thread 46 which moves in the direction of an arrow G along with the needle thread guide face 31 is guided to a position circumferentially beyond the axis l3. The needle thread 46 then is transferred onto the outer circumferential face 47 of the bobbin case 37, thereby providing reliable thread transfer.

Figure 3:
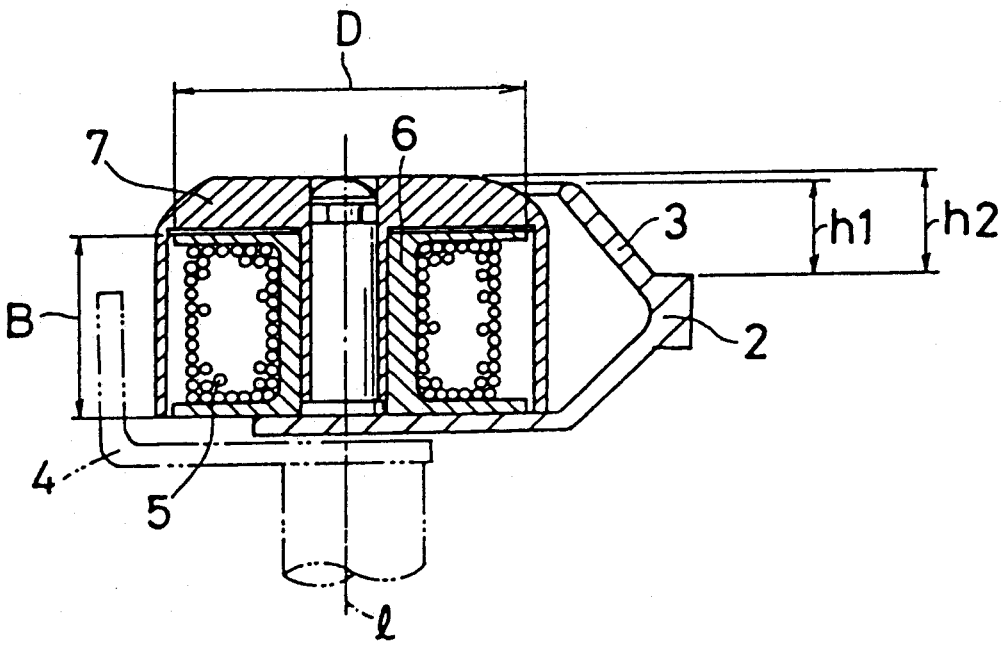
Fig. 3 PRIOR ART
FIG. 3 is a sectional view of the oscillating loop taker of FIG. 1.

In addition, as the angle 81 is set to be a desirable value, that is a value such that the needle thread 46 can smoothly slide and can be guided in the direction of arrow G along the needle thread guide face 31, in accompaniment with upward movement of a balance, not illustrated herein, the needle thread 46 can be easily transferred from the guiding face 31 onto the outer circumferential face 47 at a position further beyond the axis l3. Thereby, unnecessary tension will not be imparted to the needle thread Therefore, thread tightness will not be worsened and thread cutoff will not be caused. Thus, the configuration of needle thread guiding projection 26 enables guiding and transfer of the needle thread 46 to be smooth and reliable If recessed face 52 is not provided on the outer circumferential face 47 of the bobbin case and the width B 10 of the bobbin is enlarged, an upper end corner portion 70 on the outer circumferential face 47 is radially and axially enlarged, as shown by an imaginary line 71, as the width B 10 increases. On the other hand, it is necessary for the needle thread to be moved reasonably in the direction of arrow F, which is the passing-through direction of the needle thread in FIG. 10. However, if the corner portion 70 is enlarged as at 71, it will become difficult for the needle thread to transfer onto the outer surface 53 of the bobbin case, and the needle thread is wound on the outer circumferential face 47. In order to avoid the above phenomenon it is necessary that the corner portion 70 is positioned axially inwardly of or below a distance H1. To realize this condition, in this preferred embodiment, the radius of the outer circumferential face 47 of the bobbin case is enlarged in the area in which the outer circumferential face 47 does not interfere with the projection 26, to such a degree that it does not exceed the dimension R2 in FIG. 7, thereby achieving the desired position of the corner portion 70. Namely, as with the relationship between the recessed face 52 and the outer circumferential face 47, the position of the corner portion 70 can be lowered by enlarging the outer circumferential face 47. Therefore, a distance H2 from the bobbin case holder rib 36 to the outer surface of the bobbin case 37 can be enlarged, thereby enabling the width B 10 of the bobbin 39 to be enlarged. In an oscillating loop taker including such a bobbin 39, the distance h2 can be larger than the distance h2 in FIG. 3 when the distance h1 from the bobbin case holder rib 2 of the bobbin case holder 3 in the prior art shown in FIG. 3 is equal to the distance H1 of the invention (i.e., h1 =H1). The axial width B 10 of the bobbin 39 which is housed in such a bobbin case 37 can be made larger by, for instance, 3 mm than the width B of the prior art arrangement, thereby increasing the winding capacity of the bobbin thread 38 wound in the bobbin 39.

The invention may be embodied in other specific forms without departing from the spirit or essential characteristics thereof. The present embodiments are therefore to be considered in all respects as illustrative an not restrictive, the scope of the invention being indicated by the appended claims rather than by the foregoing description, and all changes which come within the meaning and the range of equivalency of the claims are therefore intended to be embraced therein.

What is claimed is:

1. In a bobbin case holder to be employed in an oscillating loop taker, said bobbin case holder including means defining an axis of oscillation and means defining a space to receive a bobbin case, said bobbin case holder having a circumferentially extending recess defined between a radially outer, circumferentially extending wedge and a radially inner, circumferentially extending first projection, the improvement wherein:

a radiall dimension from said axis to an inner leading end portion of said first projection is less than a radial dimension from said axis to an inner surface defining said space at a base end of said first projection;

said first projection has a radially outer surface defining said recess and inclined radially inwardly toward said leading end portion; and said bobbin case holder has a circumferentially extending second projection spaced axially of said first projection, said second projection having an inner leading end portion spaced radially from said axis further than said inner leading end portion of said first projection.

2. In an oscillating loop taker including a bobbin case holder including means defining an axis of oscillation and means defining a space to receive a bobbin case, said bobbin case holder having a circumferentially extending recess defined between a radially outer, circumferentially extending wedge and a radially inner, circumferentially extending first projection, a driver member oscillatable about said axis to oscillate said bobbin case holder in opposite directions about said axis, and a bobbin case mounted in said space, the improvement wherein:

a radial dimension from said axis to an inner leading end portion of said first projection is less than a radial dimension from said axis to an inner surface defining said space at a base end of said first projection;

said first projection has a radially outer surface defining said recess and inclined radially inwardly toward said leading end portion; and said bobbin case holder has a circumferentially extending second projection spaced axially of said first projection, said second projection having an inner leading end portion spaced radially from said axis further than said inner leading end portion of said first projection.

3. The improvement claimed in claim 1, wherein said bobbin case has an outer peripheral surface having formed in a portion thereof a circumferential recess defined by a surface of reduced radius.

4. The improvement claimed in claim 1, wherein said bobbin case has an axial end surface extending axially beyond an adjacent open end of said bobbin case holder by approximately 3 mm.

* * * * *